United States Patent [19]

Takahashi

[11] Patent Number: 5,016,866

[45] Date of Patent: May 21, 1991

[54] SHEET FEED MECHANISM FOR AN IMAGE RECORDER

[75] Inventor: Shuji Takahashi, Urawa, Japan

[73] Assignee: Ricoh Company, Ltd., Tokyo, Japan

[21] Appl. No.: 437,810

[22] Filed: Nov. 17, 1989

[30] Foreign Application Priority Data

| | | | |
|---|---|---|---|
| Nov. 17, 1988 | [JP] | Japan | 63-288952 |
| Mar. 27, 1989 | [JP] | Japan | 1-71892 |
| May 1, 1989 | [JP] | Japan | 1-109193 |

[51] Int. Cl.[5] ..... B65H 3/52

[52] U.S. Cl. ..... 271/122; 271/125

[58] Field of Search ..... 271/125, 124, 122, 121, 271/116, 126, 127

[56] References Cited

U.S. PATENT DOCUMENTS

| | | | |
|---|---|---|---|
| 4,368,881 | 1/1983 | Landa | 271/122 |
| 4,627,607 | 12/1986 | Ishii | 271/122 |
| 4,765,605 | 8/1988 | Abbott | 271/127 X |
| 4,801,134 | 1/1989 | Yokoyama et al. | 271/122 |
| 4,830,353 | 5/1989 | Hendriks et al. | 271/127 X |
| 4,896,871 | 1/1990 | Idenawa | 271/127 X |

FOREIGN PATENT DOCUMENTS

| | | | |
|---|---|---|---|
| 35716 | 3/1980 | Japan | 221/122 |
| 40121 | 3/1980 | Japan | 271/122 |
| 119526 | 7/1983 | Japan | 271/122 |
| 188248 | 9/1985 | Japan | 271/122 |

*Primary Examiner*—David H. Bollinger

*Attorney, Agent, or Firm*—Oblon, Spivak, McClelland, Maier & Neustadt

[57] ABSTRACT

A sheet feed mechanism installed in an image recorder for feeding sheets one by one out of a sheet cassette. A feed roller is driven in a rotary motion at a predetermined timing in a direction for feeding a sheet, while a reverse roller is pressed against the feed roller and driven in a rotary motion by a predetermined torque in a direction for returning the sheet. The feed roller functions to feed sheets out of the cassette alone. The feed roller and reverse roller cooperate to separate the sheets which are fed by the feed roller. A reverse shaft is formed integrally with the reverse roller. A torque limiter has a fixed hub and a free hub and provided integrally with the reverse roller and reverse shaft. A stop gear has a one-way clutch and engaged with the free hub. A coil spring generates a reverse torque.

7 Claims, 5 Drawing Sheets

SHEET FEED MECHANISM FOR AN IMAGE RECORDER

BACKGROUND OF THE INVENTION

The present invention relates to an image recorder for recording images on sheets and, more particularly, to a mechanism installed in a sheet feeding device of such an image recorder for feeding sheets one by one out of a sheet cassette.

In an electrophotographic copier, facsimile machine, laser printer or similar image recorder, a latent image representative of a document image is electrostatically formed on a photoconductive element or similar image carrier and then developed by a developer such as a toner. The developed image or toner image is transferred to a sheet which is fed from a sheet cassette of a sheet feeding device which is loaded with a stack of sheets. The sheet with the toner image is transported to a fixing station to fix the toner image. The sheet feeding device includes a mechanism for driving sheets one by one out of the sheet cassette as stated above. The sheet feed mechanism usually includes a cassette elevating device which is so arranged as to raise the sheet cassette until a pick-up roller exerts a predetermined pressure on the sheets. While the pick-up roller drives the sheets outward, a feed roller and a reverse roller cooperate to separate the uppermost sheet from the others and feed it toward the photoconductive element on which the toner image is formed. A support arm is affixed to the sheet cassette at one end thereof. An arm is rotatably mounted on the other end of the support arm. The reverse roller is mounted on a shaft which is in turn mounted on one end of the arm. A reverse motor is drivably connected to the reverse roller via a drive gear, driven gear, etc. A spring is anchored to the other end of the arm to constantly bias the arm toward the sheet cassette. The pressure exerted by the pick-up roller on the sheets, i.e., pick-up roller pressure, is controlled to a predetermined value by operating the cassette elevating mechanism. The pressure exerted by the reverse roller on the feed roller, i.e., reverse pressure, is generated by the particular angle of the arm to the cassette, the gear ratio of the gear elements, and the force of the spring.

A problem with the prior art sheet feed mechanism stated above is that the structure is complicated and the production cost is high, because the pick-up roller for driving the sheets and the cassette elevating mechanism for setting up a predetermined roller pressure are essential. Another problem is that the gears, arm and spring are located between opposite side walls of the image recorder and obstruct maintenance, manipulations for setting the reverse pressure, etc. Furthermore, since the reverse roller is constantly subjected to a force which tends to drive it in the reverse direction, an anti-reverse clutch has to be provided for preventing the feed roller from being reversed while it is not driven, aggravating the complicated structure of the mechanism.

SUMMARY OF THE INVENTION

It is therefore an object of the present invention to provide a sheet feed mechanism for an image recorder which is simple and inexpensive and promotes easy maintenance and adjustment.

It is another object of the present invention to provide a generally improved sheet feed mechanism for an image recorder.

In accordance with the present invention, a sheet feed mechanism for a sheet feeding apparatus of an image recorder which has a sheet cassette loaded with a stack of sheets comprises a feed roller driven in a rotary motion at a predetermined timing in a direction for feeding a sheet, and a reverse roller pressed against the feed roller and driven in a rotary motion by a predetermined torque in a direction for returning the sheet. The feed roller feeds sheets one by one out of the sheet cassette alone.

Also, in accordance with the present invention, a sheet feed mechanism having a torque limiter comprises a feed roller driven in a rotary motion at a predetermined timing in one direction, a reverse roller pressed against the feed roller, a reverse shaft formed integrally with the reverse roller, a torque limiter unit having a fixed hub and a free hub and provided integrally with the reverse roller and reverse shaft, a stop gear having a one-way clutch and engaged with the free hub, and a coil spring for generating a reverse torque.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
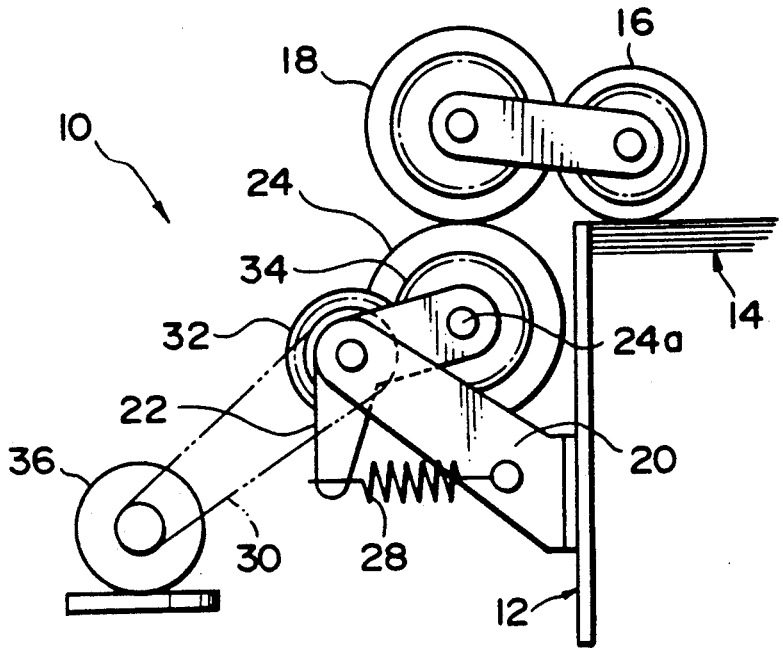
FIG. 1 PRIOR ART
FIG. 1 is a front view of a prior art sheet feed mechanism for an image recorder.
Figure 2:
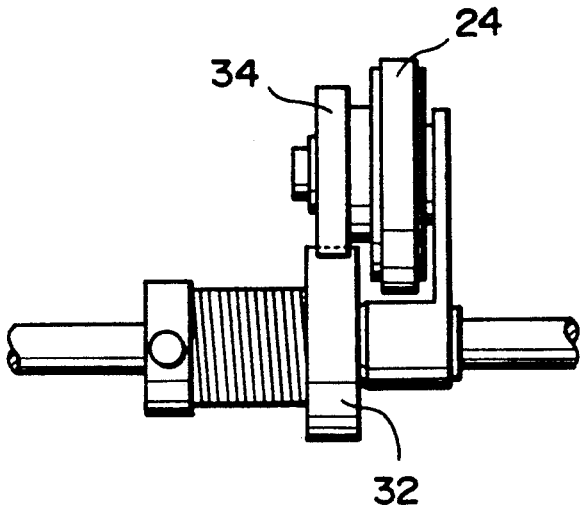
FIG. 2 PRIOR ART
FIG. 2 is a side elevation of the mechanism shown in FIG. 1.

To better understand the present invention, a brief reference will be made to a prior art sheet feed mechanism, shown in FIGS. 1 and 2. As shown, the sheet feed mechanism, generally 10, has a pick-up roller 16 and a feed roller 18 connected to the pick-up roller 16 as illustrated. The pick-up roller 16 is held in contact with the uppermost one of sheets 14 which are stacked on a sheet cassette 12. A support arm 20 is securely connected to the sheet cassette 12, while an arm 22 is rotatably mounted on the end of the support arm 20. A reverse roller 24 is mounted on a shaft **24*a* and located to adjoin the feed roller 18. The shaft 24*a* is mounted on one end of the arm 22. A spring 28 is anchored at one end to the other end of the arm 22 and at the other end to the support arm 20. The spring 28 constantly biases the above-mentioned other end of the support arm 20 toward the sheet cassette 12. The reverse roller 24 is driven by a reverse motor 36 via a belt 30, a drive gear 32, and a driven gear 34. The reverse roller 24 exerts on the feed roller 18 a reverse pressure which is generated by the particular angle of the arm 22 to the sheet cassette 12, the gear ratio of the drive gear 32 and driven gear 34, and the preload of the spring 28. The reverse pressure is adjusted to a predetermined value, and then a device for elevating the cassette 12 is operated to maintain the roller pressure of the pick-up roller 16 at a predetermined value. In this condition, as the sheet feed mechanism 10 is driven, the sheet 14 is picked up by the pick-up roller 16 and then fed out by the feed roller 18 and reverse roller 24** while being separated from the others.

As stated above, the prior art sheet feed mechanism 10 needs the pick-up roller 16 and the mechanism for elevating the sheet cassette 12 to set up the roller pressure of the pick-up roller 16. This complicates the structure and increases the cost. Since the drive gear 32, driven gear 34, arm 22 and spring 28 are located between opposite side walls of an image recorder in which the mechanism 10 is incorporated, they interfere with manipulations for maintenance and the setting of the reverse pressure. The reverse pressure is set up by the force of the spring 28, the angle of the arm 22 to the sheet cassette 12, and the gear ratio of the gears 32 and 34 and, therefore, it needs a pressure force generated by gears. Further, since the reverse roller 24 is constantly urged to rotate in the reverse direction, an anti-reverse clutch has to be provided for preventing the feed roller 18 from being reversed when it is not operated. These aggravate the complexity of construction.

Figure 3:
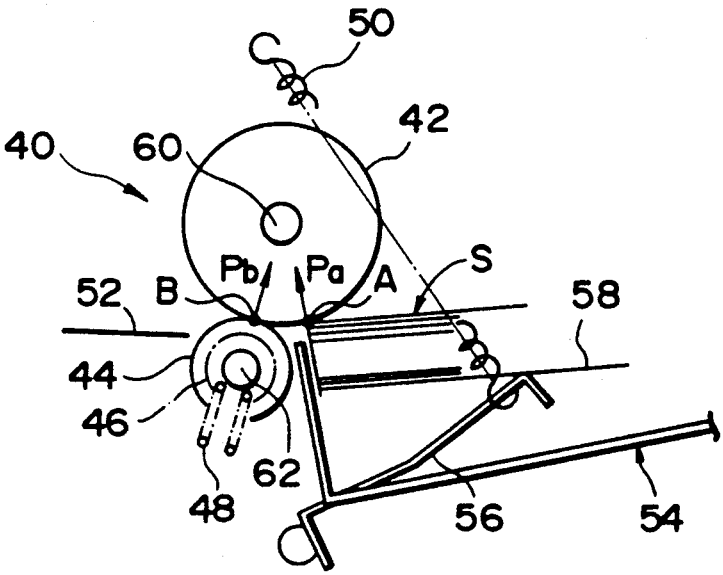
FIG. 3 is a front view of a sheet feed mechanism embodying the present invention.
Figure 4:
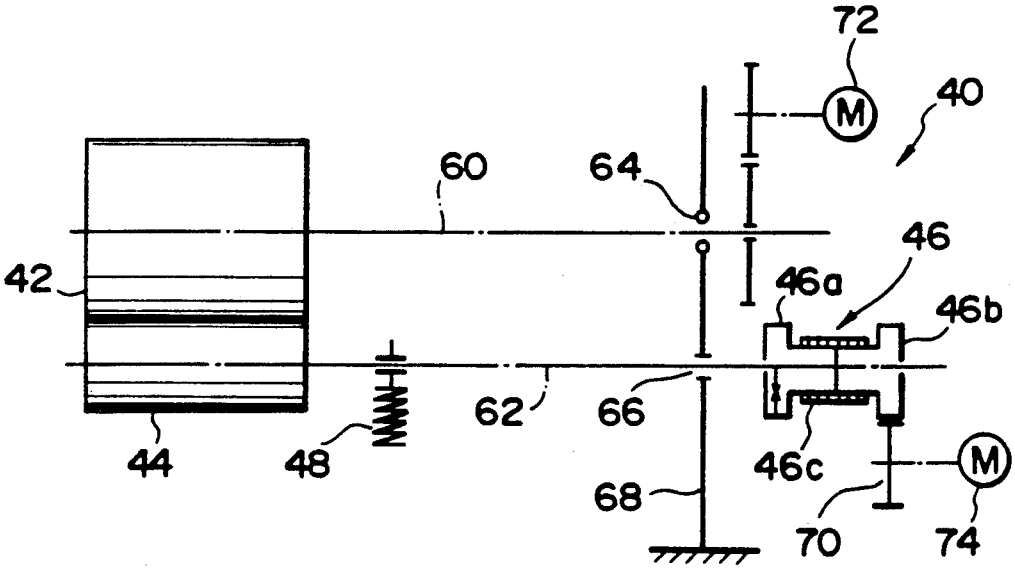
FIG. 4 is a side elevation of the mechanism shown in FIG. 3.

Referring to FIG. 3, a sheet feed mechanism embodying the present invention is shown and generally designated by the reference numeral 40. The sheet feed mechanism 40 has a feed roller 42, a reverse roller 44, a torque limiter 46, a reverse spring 48, a sheet biasing spring 50, and a guide plate 52. In this particular embodiment, the feed roller 42 is made of rubber and has a diameter of 36 millimeters, while the reverse roller 44 is made of $\mu$ rubber and has a diameter of 18 millimeters. A sheet cassette 54 loaded with a stack of paper sheets S has a pressing arm 56 and a bottom plate 58. Further, as shown in FIG. 4, the mechanism 40 has a feed roller shaft 60, a reverse shaft 62, an anti-reverse clutch 64 and a bearing 66 which are mounted on a side wall 68 of an image recorder, a drive gear 70, a feed motor 72, and a reverse motor 74. The torque limiter 46 is made up of a fixed hub **46*a*, a free hub 46*b*, and a coil spring 46*c***.

As shown in FIG. 3, the pressing arm 56 is held in pressing contact with the bottom wall 58 of the sheet cassette 54 on which the sheets S are stacked. The spring 50 is anchored to the pressing arm 56 so that the upper end of the sheet stack S is pressed against the feed roller 42 by a predetermined pressure by the spring 50 and arm 56. The shaft 60 on which the feed roller 42 is mounted is driven by a feed motor 72 in a direction for feeding the sheets S. The reverse roller 44 is located in close proximity to the feed roller 42. As shown in FIG. 4, the end of the feed roller shaft 60 extends through the side wall 68 to the outside. The anti-reverse clutch 64 is interposed between the side wall 68 and the feed roller shaft 60. A one-way clutch thus is associated with the feed roller 42. The spring 48 is anchored to the shaft 62 on which the reverse roller 44 is mounted. The end of the reverse shaft 62 also extends through the side wall 68 to the outside via the bearing 66. The torque limiter 46 is mounted on the outer end of the reverse shaft 62. The drive gear 70 is held in mesh with the free hub **46*b* of the torque limiter 46 and driven in one direction by the reverse motor 74. The pressing arm 56 and spring 50 generate a pressure necessary for feeding the sheet S to a separating position, i.e. a feed pressure Pa. On the other hand, the spring 48, reverse shaft 62 and torque limiter 46 which determines a returning force Ta (FIG. 5) of the reverse roller 44 cooperate to generate a reverse pressure Pb at the separating position. The one-way clutch associated with the feed roller 42 allows the feed roller 42 to follow the movement of the paper sheet S when the paper sheet S is pulled by an ordinary register section. The anti-reverse clutch 64 prevents the feed roller 42 from being rotated in the reverse direction by the reverse roller 44** when no sheets S exist at the separating position.

Figure 5:
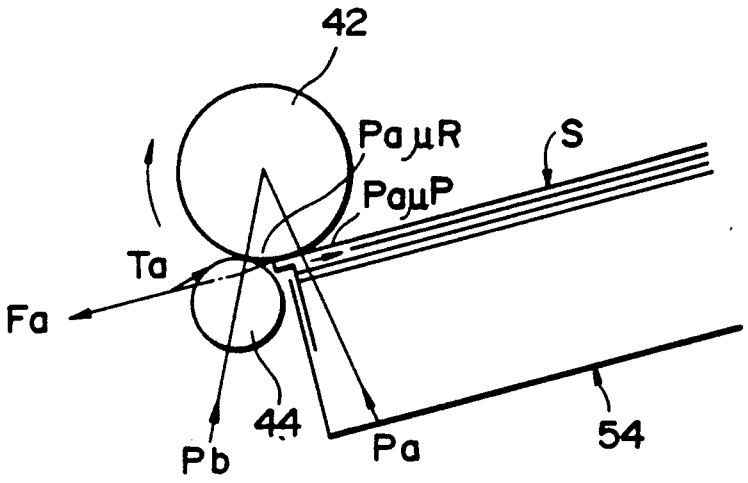
FIG. 5 is a schematic view demonstrating how the mechanism of FIG. 3 picks up sheets.

In operation, the sheet stack S loaded in the cassette 54 is raised by the bottom wall 58, pressing arm 56 and spring 50 so that the uppermost paper sheet S abuts against the feed roller 42 which is fixed in position. This sets up the feed pressure Pa and applies it to the feed roller 42. As shown in FIG. 5, assuming that the coefficient of friction between the feed roller 42 and the sheet S is $\mu R$, and the coefficient of friction between the paper sheets S themselves is $\mu P$, the feed roller 42 exerts on the sheet S a transporting force Fa which is expressed as:

$$Fa = Pa(\mu R - \mu P) \quad (1)$$

By substituting specific coefficients of friction $\mu R = 1.58$ and $\mu P = 0.52$ for the equation (1), there is obtained:

$$Fa = 1.06Pa \quad (2)$$

Figure 6:
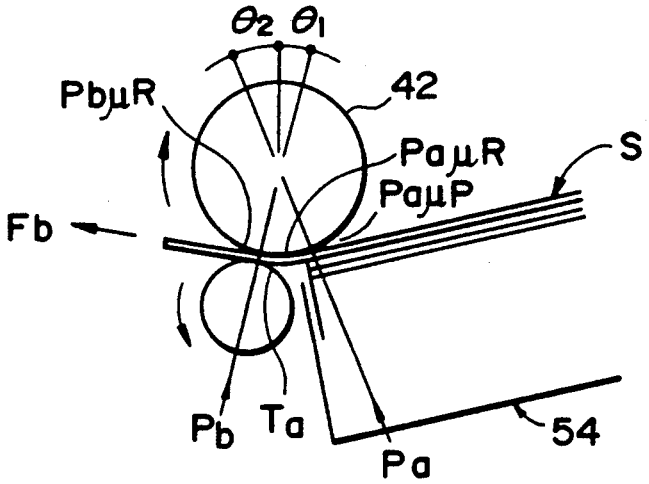
FIG. 6 is a view similar to FIG. 5, showing how the mechanism of FIG. 3 transports a sheet.

Referring to FIG. 6, how the feed roller 42 and reverse roller 44 transport the sheet S is shown schematically. As shown, the feed roller 42 receives not only the feed pressure Pa but also the reverse pressure Pb which is generated by the reverse roller 44. As shown in FIG. 4, the torque of the drive gear 70 is cancelled by the bearing 66. Hence, in the illustrative embodiment, the reverse pressure Pb is determined by the force of the spring 48 and remains constant with no regard to the condition of the reverse roller 44, i.e., whether it is rotating in the forward direction (driven by the sheet S), reversed, or apparently held in a halt.

When the reverse motor 74 shown in FIG. 4 is energized, it rotates the drive gear 70. At this stage of operation, the feed motor 72 is not energized. The rotation of the drive gear 70 is transmitted to the torque limiter 46 which is made up of the stationary hub **46*a* mounted on the reverse shaft 62, free hub 46*b*, and coil spring 46*c*. The resulting limiter torque Tl (gf.cm) is exerted as a limited force Ta (gf) in a direction opposite to the intended direction paper transport, as shown in FIG. 6. The reverse pressure Pb is generated by the spring 48, as stated earlier. A prerequisite with the reverse pressure Pb is that a relationship $Pb \cdot \mu RR > Ta$ holds, where $\mu RR$ is the coefficient of friction of the $\mu$ rubber of which the feed roller 42 and reverse roller 44 are made. Should $Pb \cdot \mu RR < Ta$, the reverse roller 44 would begin rotating in the reverse direction with the feed motor 72** being deenergized and the reverse motor 74 being energized. If a sheet S exists at the separating position at that time, its leading edge is apt to fold.

Under the above condition, a transporting force Fb exerted by the feed roller 42 and reverse roller 44 on the paper sheet S as shown in FIG. 6 is produced by:

$$Fb \approx Pb\mu R + Pa\mu R - (Ta + Pa\mu P) \quad (3)$$

In the equation (3), the influence of angles $\theta_1$ and $\theta_2$ shown in FIG. 6 are neglected.

As FIG. 6 indicates, while a single paper sheet S is transported, the reverse roller 44 is rotated in the forward direction by the feed roller 42. However, when the next paper sheet S is located in the separating position, the reverse roller 44 is halted. Specifically, in the illustrative embodiment, when a single paper sheet S is fed to and driven by a register roller pair (not shown) which is located downstream of the mechanism shown in FIG. 3, the feed roller 42 is deactivated and the reverse roller 44 is activated so that both of them are rotated in the same direction by the paper sheet S. While the trailing edge of the paper sheet S moves away from a position A toward a position B shown in FIG. 3, the next paper sheet S tends to abut against and be fed by the feed roller 42 toward the position B. In FIG. 6, in order to transport a single paper sheet S to the separating position, the force Fb included in the equation (3) should be greater than zero. Hence, from the Eq. (3), there is obtained:

$$Pb > \frac{1}{\mu R} Ta + \left(\frac{\mu P}{\mu R} - 1\right) Pa \quad (4)$$

By substituting the actual coefficients of friction $\mu R = 1.58$ and $\mu P = 0.52$ for the above relation (4), there is produced:

$$Pb > 0.633Ta - 0.671Pa \quad (5)$$

Figure 7:
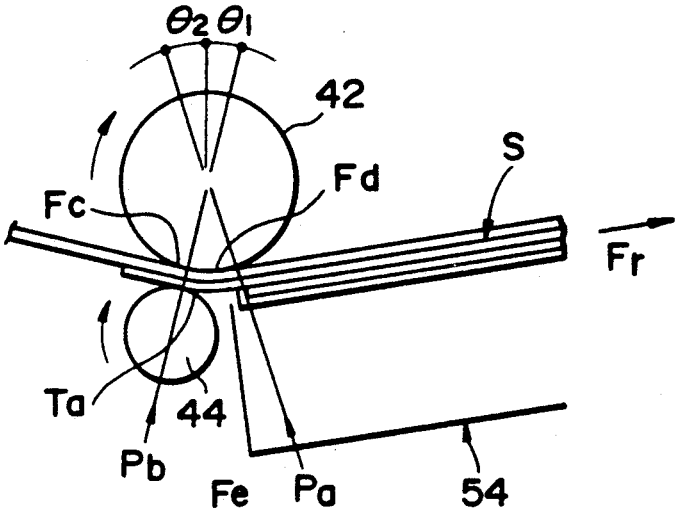
FIG. 7 is a view similar to FIG. 5, showing how the mechanism of FIG. 3 separates a sheet.

FIG. 7 shows the motions of the feed roller 42 and reverse roller 44 for separating a paper sheet S from the others. Assuming that the weight of a single sheet S is m, a separating force Fr exerted by the feed roller 42 and reverse roller 44 on the paper sheet S is expressed as:

$$Fr = Ta - \mu PPb - \mu P(Pa + m) - \mu P(Pa + 2m) \quad (6)$$

In the equation (6), the force Fr should be greater than zero to effect the separation. Hence, from the equation (6), there is produced:

$$Ta > \mu PPb + \mu P(Pa + m) + \mu P(Pa + 2m) \approx \mu PPb + 2\mu PPa \quad (7)$$

Substituting the specific coefficients of friction $\mu R = 1.58$ and $\mu P = 0.52$ of the illustrative embodiment to the relation (7), $$Ta > 0.52Pb + 1.04Pa \quad (8)$$

From the relation (8), $$Pb < 1.92Ta - 2Pa \quad (9)$$

Specific values resulting from the equation (2) and relations (5) and (9) are shown in Table 1 below, with respect to Pa which is 100, 200 and 300.

TABLE 1

| DIVISION | RELATION | Pa 100 | Pa 200 | Pa 300 |
|---|---|---|---|---|
| equation (2) | Fa = 1.06 Pa | 106 | 216 | 318 |
| equation (5) | Pb > 0.633 Ta −0.671 Pa | 0.633 Ta −67 | 0.633 Ta −134 | 0.633 Ta −201 |
| equation (9) | Pb < 1.92 Ta −2 Pa | 1.92 Ta −200 | 1.92 Ta −400 | 1.92 Ta −600 |

Figure 8:
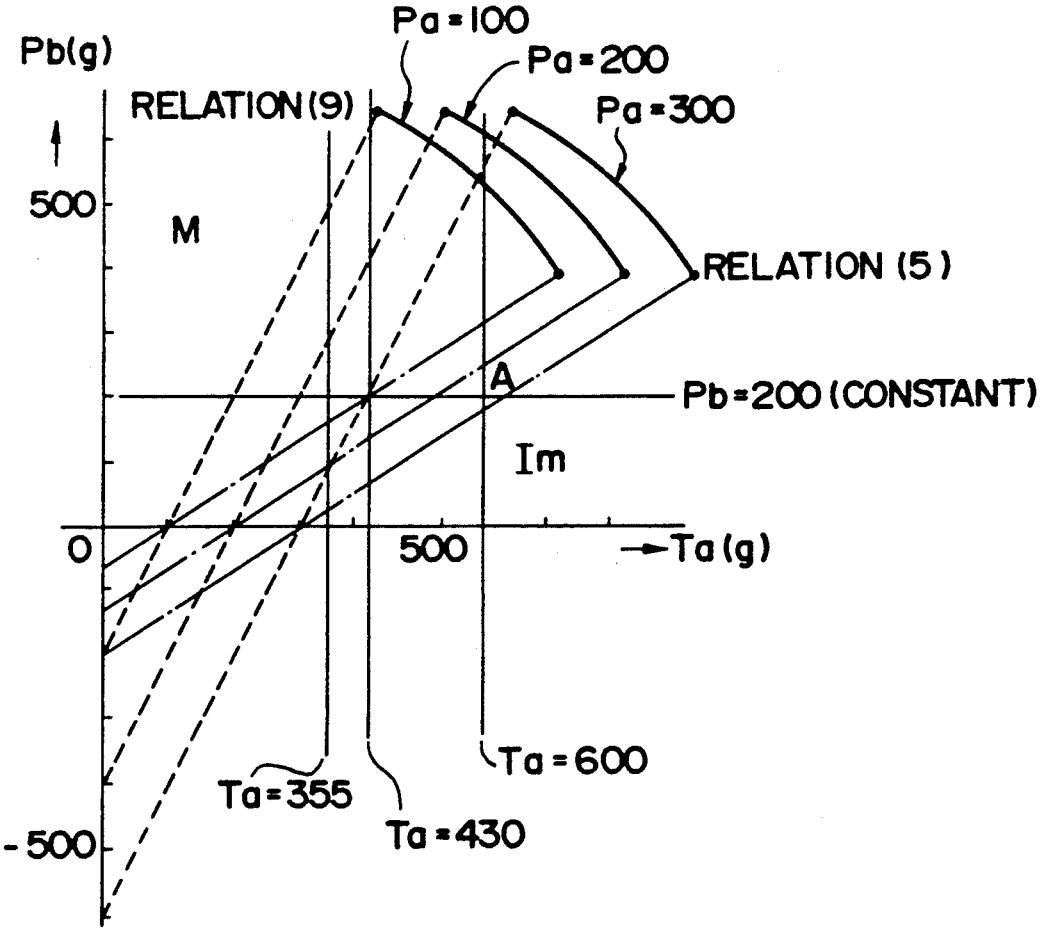
FIG. 8 is a graph showing a relationship between the returning force of a reverse roller and a reverse pressure particular to the illustrative embodiment.

FIG. 8 is a graph showing a relationship between the returning force Ta of the reverse roller 44 and the reverse pressure Pb. In the figure, the sectorial regions defined by the border lines between the relations (5) and (9) are the adequate feed regions. A non-feed region Im and a multi-feed region M exist on opposite sides of the adequate feed regions. In this embodiment, the reverse pressure Pb is maintained constant.

As stated above, the illustrative embodiment is implemented by only two rollers 42 and 44 and eliminates the need for a sheet cassette elevating mechanism. The mechanism is, therefore, simple in construction and inexpensive. Since the reverse motor 74, drive gear 70, torque limiter 46 and feed motor 72 are located at the outside of the side wall 68 of the image recorder, easy access for maintenance and adjustment is insured. The reverse roller 44 is smaller in diameter than a conventional reverse roller whose diameter is about 27 millimeters. This reduces the required limiter torque (gf. cm) and, therefore, the overall dimensions of the sheet feed mechanism, thereby further promoting the cut-down of cost. The separating function is achievable only if the feed roller 42, reverse roller 44 and their shafts, spring 48 and bracket are located in the space between the opposite side walls of the image recorder and where a sheet S is transported. Such a structure promotes easy removal of a jamming sheet, for example. The absence of a pick-up roller allows the sheet feed mechanism to readily adapt itself to front sheet loading which is expected to be predominant in the future. The coefficient of friction of the reverse roller 44 can be selected to be as great as that of the feed roller 42, enhancing reliable operations.

Figure 9:
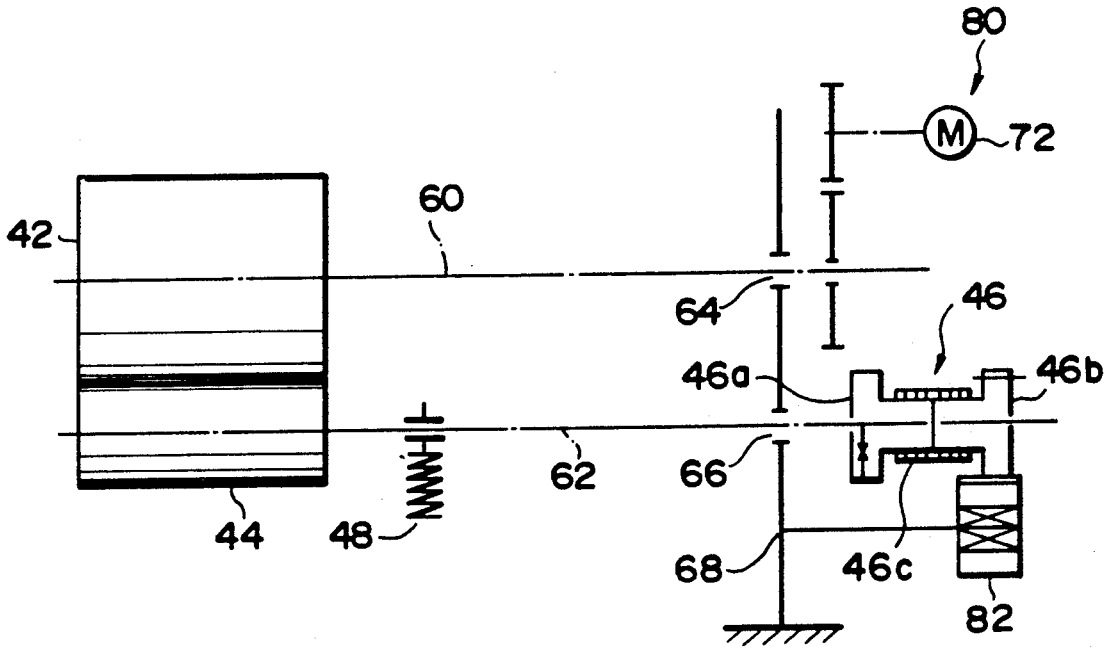
FIG. 9 is a side elevation showing an alternative embodiment of the sheet feed mechanism in accordance with the illustrative embodiment.

Referring to FIG. 9, an alternative embodiment of the present invention is shown. In the figure, the same components and structural elements are designated by like reference numerals, and redundant description will be avoided for simplicity. As shown, the sheet feed mechanism, generally 80, differs from the mechanism 40 in that it includes a stop gear 82 having a one-way clutch. The torque limiter 46 having the coil spring **46*c*, free hub 46*b* and fixed hub 46*a* produces an overrun torque $T_0$ to thereby implement the returning force Ta of the reverse roller 44. One-way clutch is associated with the feed roller 42 for causing the latter to follow the movement of a paper sheet S when the paper sheet S is pulled by a register section. The reverse roller 44 is not coupled to a motor or similar reverse drive source. When the reverse roller 44 is rotated in the reverse direction by the stop gear 82 which meshes with the free hub 46*b* of the torque limiter 46, the free hub 46*b* is free to rotate; when the reverse roller 44 follows the rotation of the feed roller 42, the free hub 46*b* is locked in position. Hence, the reverse roller 44 follows the rotation of the feed roller 42** when a single sheet S is transported, and it is held in a halt when two sheets are separated from each other.

Figure 10:
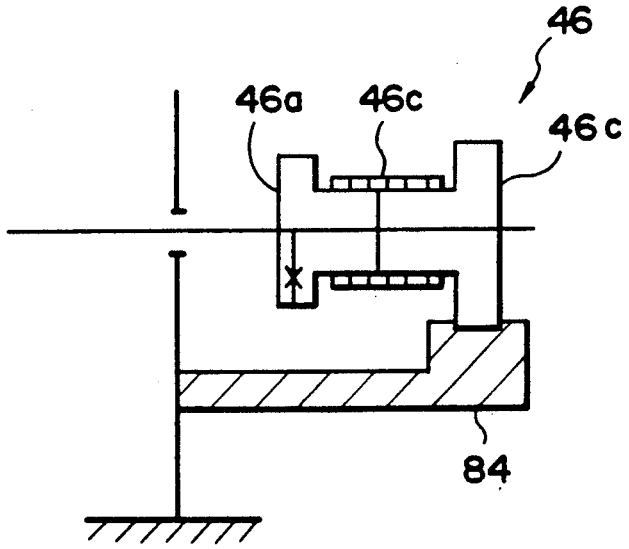
FIG. 10 is an enlarged side elevation showing another alternative embodiment of the sheet feed mechanism in accordance with the present invention.

FIG. 10 shows another alternative embodiment of the sheet feed mechanism in accordance with the present invention. In this particular embodiment, the free hub 46*b* of the torque limiter 46 is locked by a free hub locking plate 84. Specifically, the locking plate 84 locks the free hub 46*b* in place when the reverse roller 44 tends to rotate in the reverse direction and when the reverse roller 44 tends to follow the rotation of the feed roller 42. This embodiment is identical with the preceding embodiments concerning the transport of a sheet S.

In the embodiments shown in FIGS. 9 and 10, the torque of the reverse roller 44 is derived from the overrun torque T of the coil spring 46*c*, free hub 46*b* and fixed hub 46*a* of the torque limiter 46. Hence, the overrun torque $T_0$ acts in a "loosening direction" of the coil spring 46*c* as distinguished from a "winding direction", i.e., in the opposite direction to the direction of sheet transport. If desired, the coil spring 46*c* may be replaced with a suitable friction member such as a powder clutch or a leaf spring clutch. Such a friction member is usually rotatable in opposite directions and generates the same friction torque with no regard to the direction of rotation. The friction member, therefore, will be arranged and operated in exactly the same manner as in the embodiment of FIG. 9; even when the free hub locking plate 84 shown in FIG. 10 locks the free hub 46*b*, the reverse roller 44 is rotatable in the reverse direction. Since the pressure force relying on gear drive which is particular to the prior art is absent, the pressure of the reverse roller 44 acting at the position B as shown in FIG. 3 depends on the spring 48 only and is not related to the value of the reverse torque Ta which is generated by the torque limiter 46. In the illustrative embodiment, the reverse torque is produced by the coil spring 46*c*, and the stop gear 82 with a one-way clutch is meshed with the free hub 46*b*. The stop gear 82 locks the free hub 46*b* in a direction for following the rotation of the feed roller 42 to thereby activate the reverse torque, while the feed roller 42 is rotatable in the direction opposite to the feed roller 42 with no torque acting thereon. This allows one to readily remove a jamming sheet from the sheet feed section with a minimum of effort. Since the free hub 46*b* is locked by the free hub locking plate 84 and since the locking plate 84 is less expensive than the stop gear 82, the transport and separation of a sheet S is easy and cost-effective. Furthermore, when the reverse torque is implemented by a friction member in place of the coil spring 46*c*, the advantage described above in relation to a sheet jam is also achievable without resorting to the stop gear 82, i.e., based on the configuration of the locking plate 84.

In any of the embodiments shown and described, the sheet feed mechanism has the reverse roller 42 which is free from a reverse drive source. This makes it needless to take account of the wear of the coil spring 46*c*. The mechanism does not need an exclusive clutch for preventing the reversal of the feed roller 42 and is, therfore, low cost. Since the sheet separating function can be satisfied only if the feed roller 42, reverse roller 44, roller shafts 60 and 62, spring 48 and bracket (not shown) are located in the space between the side walls 68 where a sheet moves, the mechanism is simple in construction and facilitates the removal of a jamming sheet, for example. The mechanism, like the separation-by-friction type mechanism shown in FIG. 1, has the reverse roller 44 having a large coefficient of friction and eliminates the need for reducing it beyond the coefficient friction of the feed roller 42. More specifically, the coefficient of friction of the rollers 42 and 44 is larger than that of the sheets and thereby enhances the reliability of operation.

In summary, it will be seen that the present invention provides a sheet feed mechanism which is simple, miniature and inexpensive and promotes the ease of maintenance and adjustment while insuring positive separation of a sheet.

Various modifications will become possible for those skilled in the art after receiving the teaching of the present disclosure without departing from the scope thereof.

What is claimed is:

1. A sheet feed mechanism for a sheet feeding apparatus of an image recorder which has a sheet cassette loaded with a stack of sheets, comprising:

a feed roller driven in a rotary motion at a predetermined timing in a direction for feeding a topmost sheet of said stack;

a reverse roller pressed against said feed roller with a reverse pressure and driven in a rotary motion by a predetermined torque in a direction for returning the sheet, wherein said feed roller and said reverse roller constitute separating means for separating the sheets which are fed by said sheet feeding means;

spring means for biasing said sheets in said cassette upwards against said feed roller with a feed pressure, said feed roller alone constituting sheet feeding means which feeds sheets one by one out of the sheet cassette;

a reverse shaft formed integrally with said reverse roller;

a torque limiter having a fixed hub and a free hub, said fixed hub being provided integrally with said reverse shaft;

a stop gear having one-way clutch and engaged with said free hub; and a sheet biasing spring for generating a reverse torque in said reverse shaft.

2. The sheet feed mechanism of claim 1 including an anti-reverse clutch for preventing the feed roller from being driven in a reverse direction by the reverse roller.

3. A sheet feed mechanism, comprising:

a feed roller driven in a rotary motion at a predetermined timing in one direction;

a reverse roller pressed against said feed roller;

a reverse shaft formed integrally with said reverse roller;

a torque limiter unit having a fixed hub and a free hub, said fixed hub being provided integrally with said reverse shaft;

a stop gear having a one-way clutch and engaged with said free hub; and a sheet biasing spring for generating a reverse torque in said reverse shaft.

4. A sheet feed mechanism for a sheet feeding apparatus of an image recorder which has a sheet cassette loaded with a stack of sheets, comprising:

a feed roller driven in a rotary motion at a predetermined timing in a direction for feeding a topmost sheet of said stack, a leading edge portion of which abuts against said feed roller;

a reverse roller pressed against said feed roller and driven in a rotary motion by a predetermined torque in a direction for returning the sheet, said reverse roller having a diameter which is smaller than that of said feed roller;

a reverse shaft provided integrally with said reverse roller;

torque generating means for generating a torque which is exerted through said reverse shaft on said reverse roller; and torque limiter means for limiting the torque generated by said torque generating means and exerted on said reverse roller to said predetermined torque, wherein said torque limiter means is provided integrally with said reverse shaft, wherein said torque limiter means has a free hub which is provided integrally with said reverse shaft and through which said torque limiter means is connected to said torque generating means, and wherein said torque generating means comprises a reverse motor and a drive gear which is driven through the free hub of said torque limiter means by said reverse motor.

5. A sheet feed mechanism as claimed in claim 4, further comprising a reverse spring provided integrally with said reverse shaft for generating a reverse torque in said reverse shaft.

6. A sheet feed mechanism for a sheet feeding apparatus of an image recorder which has a sheet cassette loaded with a stack of sheets, comprising:

a feed roller driven in a rotary motion at a predetermined timing in a direction for feeding a topmost sheet of said stack, a leading edge portion of which abuts against said feed roller;

a reverse roller pressed against said feed roller and driven in a rotary motion by a predetermined torque in a direction for returning the sheet, said reverse roller having a diameter which is smaller than that of said feed roller;

a reverse shaft provided integrally with said reverse roller;

torque generating means for generating a torque which is exerted through said reverse shaft on said reverse roller; and torque limiter means for limiting the torque generated by said torque generating means and exerted on said reverse roller to said predetermined torque, wherein said torque limiter means is provided integrally with said reverse shaft, wherein said torque limiter means has a free hub which is provided integrally with said reverse shaft and through which said torque limiter means is connected to said torque generating means, and wherein said torque generating means comprises a stop gear having a one-way clutch and engaged with the free hub of said torque limiter means.

7. A sheet feed mechanism for a sheet feeding apparatus of an image recorder which has a sheet cassette loaded with a stack of sheets, comprising:

a feed roller driven in a rotary motion at a predetermined timing in a direction for feeding a topmost sheet of said stack, a leading edge portion of which abuts against said feed roller;

a reverse roller pressed against said feed roller and driven in a rotary motion by a predetermined torque in a direction for returning the sheet, said reverse roller having a diameter which is smaller than that of said feed roller;

a reverse shaft provided integrally with said reverse roller;

torque generating means for generating a torque which is exerted through said reverse shaft on said reverse roller; and torque limiter means for limiting the torque generated by said torque generating means and exerted on said reverse roller to said predetermined torque, wherein said torque limiter means is provided integrally with said reverse shaft, wherein said torque limiter means has a free hub which is provided integrally with said reverse shaft and through which said torque limiter means is connected to said torque generating means, and wherein said torque generating means comprises a locking plate for locking the free hub of said torque limiter means.

* * * * *